United States Patent [19]

Guelpa

[11] 4,377,263

[45] Mar. 22, 1983

[54] RIBBON BREAKING METHOD AND APPARATUS

[75] Inventor: Egidio Guelpa, Pensacola, Fla.

[73] Assignee: Monsanto Company, St. Louis, Mo.

[21] Appl. No.: 274,842

[22] Filed: Jun. 18, 1981

[51] Int. Cl.[3] ..... B65H 54/38

[52] U.S. Cl. ..... 242/18.1

[58] Field of Search ..... 242/18.1, 18 R, 43 R; 318/66

[56] References Cited

U.S. PATENT DOCUMENTS

| | | | |
|---|---|---|---|
| 2,763,824 | 9/1956 | Bacheler | 242/18.1 |
| 3,241,779 | 3/1966 | Bray et al. | 242/18.1 |
| 3,315,904 | 4/1967 | Hardee | 242/18 R |
| 3,402,898 | 9/1968 | Mattingly | 242/18.1 X |
| 3,514,682 | 5/1970 | Corey | 242/18.1 X |
| 3,638,872 | 2/1972 | Jennings | 242/18.1 |
| 3,799,463 | 3/1974 | Peckinpaugh | 242/18.1 |
| 3,910,514 | 10/1975 | Hooper | 242/18.1 |

*Primary Examiner*—Stanley N. Gilreath
*Attorney, Agent, or Firm*—Kelly O. Corley

[57] ABSTRACT

Random doffing of a multiple-position winding machine is permitted by beginning yarn package formation at a high mean yarn traverse frequency provided by a first inverter, then shifting to a low mean modulated traverse frequency provided by a second inverter for further package formation. The output frequencies of the two inverters are controlled to be substantially identical at the time of transfer.

6 Claims, 3 Drawing Figures

RIBBON BREAKING METHOD AND APPARATUS

The invention relates to the art of winding large yarn packages on bobbins driven at a constant surface speed on a multi-position machine, and specifically to an improved ribbon-breaking apparatus.

In the yarn winding art, the yarn is supplied from any of several processes such as spinning, drawing, etc. and is would onto a rotating bobbin. The yarn is simultaneously traversed parallel to the bobbin axis during the winding, to form layers on the bobbin. Certain difficulties have occurred upon attempting to remove the yarn over-end from the package. When the revolutions per minute (r.p.m.) of the bobbin during the winding process have some integral whole number relationship to the traversal rate, it may be seen that the pattern of yarn placed on the package is repeated, producing an effect called "ribboning". If the traversals per minute are equal to some integral multiple of the r.p.m. of the bobbin, it may be seen that the yarn is repeatedly laid exactly on the yarn from the previous layer rather than being circumferentially displaced as is desirable, and the resulting package formation may be termed "primary" ribboning. If the traversals per minute is some odd multiple of half the revolutions per minute of the bobbin, "secondary" ribboning is produced, and so forth. When an attempt is made to remove the yarn from the bobbin over-end, as is conventional, there is a tendency for several layers to slide off the bobbin at once in regions containing ribbons. This effect is most severe for primary ribbons.

In most yarn processes, the yarn is handled at a substantially constant rate, and thus it is desirable for the take-up mechanism to drive the bobbin so as to wind up the yarn at a constant rate. This is readily achieved by driving the bobbin from its surface at a constant peripheral velocity. As the package size increases, the bobbin revolution rate decreases inversely proportional to its circumference. If the traversing mechanism operates at a constant rate, it may be seen that the ratio of traversals per bobbin revolution (hereinafter termed the traversal ratio) increases from an initial low value as the package size increases, producing the various types of ribboning as the r.p.m. passes through various values corresponding to integral sub-multiples and multiples of the traversing rate.

Various forms of ribbon breaking apparatus have been proposed, as disclosed in Bray U.S. Pat. No. 3,241,779 and Peckinpaugh U.S. Pat. No. 3,799,463, the disclosures of which are incorporated herein by reference. The Bray process would not permit random doffing (replacing a yarn package with an empty bobbin at any time) unless a separate inverter were provided for each tranverse motor. The Peckinpaugh process, while permitting random doffing, would not permit maintaining the helix angle of the yarn on the bobbin within the desired range throughout the package when large packages are wound.

These and other difficulties of the prior art are solved by the present invention by providing for driving the traverse mechanism at a high mean rate for the initial portion of package formation, then at a lower mean rate for the subsequent portion of package formation.

According to a first major aspect of the invention, there is provided a process for controlling a plurality of yarn traversing mechanisms, comprising independently connecting the traversing mechanisms to a first source of first alternating current having a first mean frequency; and independently switching the traversing mechanisms to a second source of second alternating current having a mean frequency lower than the first mean frequency. According to another aspect of the invention, the second alternating current substantially continually varies between an upper and a lower value for the second alternating current. According to another aspect of the invention, the first and the second alternating currents periodically have substantially identical frequencies to provide time intervals for bumpless transfer of the traversing mechanisms from being driven by the first alternating current source to being driven by the second alternating current source. According to another aspect of the invention, the first alternating current substantially continually varies between an upper and a lower value for the first alternating current.

According to another major aspect of the invention, there is provided a ribbon-breaking apparatus for a multiple-position winding machine comprising in combination, a first inverter providing an output frequency having a first mean value; a plurality of A.C. motors, each of the motors being coupled to drive a yarn traverse mechanism; means for independently connecting the motors to the output of the first inverter; a second inverter; second modulator means for modulating the output frequency of the second inverter about a second mean value lower than the first mean value and between second upper and lower frequencies; the second modulator means being constructed and arranged such that the output frequencies are periodically substantially identical to provide time intervals for bumpless transfer of the motors; and means for independently switching the motors from the output of the first inverter to the output of the second inverter during the time intervals. According to another aspect of the invention, the apparatus further comprises first modulator means for modulating the output frequency of the first inverter about the first mean value between first upper and lower frequencies.

Other aspects will in part appear hereinafter and will in part be obvious from the following detailed description taken in connection with the accompanying drawings, wherein.

To maintain the desired helix angle range, the average traverse rate should be high at the beginning of the doff (empty bobbin) and should decrease throughout the doff as the package size increases, since the bobbin r.p.m. is decreasing. While ideally this would be done continuously proportional to package diameter, satisfactory results are obtained by decreasing the average traverse rate in one or more steps as the package diameter increases.

Figure 1:
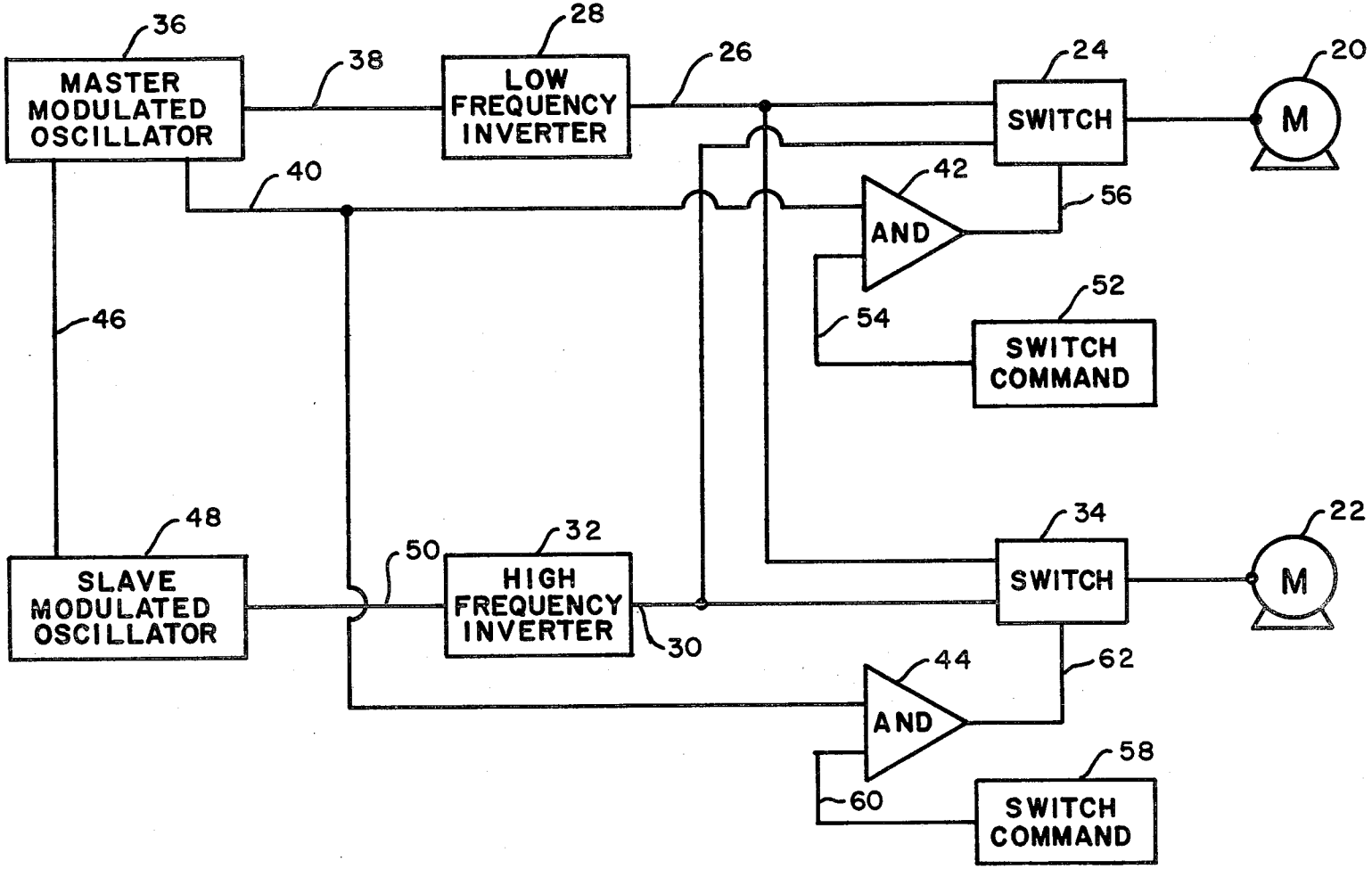
FIG. 1 is a block diagram of a system according to the invention.

As shown in FIG. 1, a plurality of motors 20 and 22 are coupled to drive non-illustrated yarn traverse mechanisms. Switch 24 alternatively connects motor 20 to the output 26 of low frequency inverter 28 or to the output 30 of high frequency inverter 32, and switch 34 alternatively connects motor 22 to output 26 or to output 30, as will be explained below. A master modulated oscillator 36 produces an output signal on conductor 38 for controlling the output frequency of inverter 28. Master oscillator 36 also produces on conductor 40 a periodic synchronization ("sync") signal to one input terminal of AND gates 42 and 44, and on conductor 46 a sync signal to slave modulated oscillator 48. Slave oscillator 48 produces on conductor 50 an output signal for controlling the output frequency of inverter 32. Switch command 52 produces a signal to the remaining input terminal 54 of AND gate 42, the output 56 of which actuates switch 24, while switch command 58 produces a signal on the remaining input terminal 60 of AND gate 44, the output 62 of which actuates switch 34.

One preferred mode of operation of the FIG. 1 system will be explained with reference to FIG. 3, which shows an illustrative program of output frequencies produced by the inverters on conductors 26 and 30. Under the control of master oscillator 36, inverter 28 produces its frequency modulated output signal, the frequency of which continually varies linearly between an upper frequency $U_R$ and a lower frequency $L_R$ about a mean frequency $M_R$. Slave oscillator 48, under the control of sync pulses 46 produced by master oscillator 36, drives inverter 32 to produce its frequency modulated output signal, the frequency of which continually varies linearly between an upper frequency $U_S$ and a lower frequency $L_S$ about a mean frequency $M_S$. Slave oscillator 48 is programmed to produce an increase in output frequency on conductor 30 up to $U_S$, then to produce a decrease in output frequency on conductor 30 until the occurrence of the leading edge of a sync pulse on conductor 46 from master oscillator 36 is received, whereupon it is programmed to repeat the process. In the illustrated program, the lower frequency $L_S$ is slightly higher than the upper frequency $U_R$, and occurs slightly before $U_R$, for reasons to be explained below.

Assume that the non-illustrated bobbin associated with motor 20 is to be replaced with an empty bobbin. The empty bobbin is placed in the winding machine and winding of the yarn begins. Switch 24 is actuated manually to connect motor 20 output 30 of high frequency inverter 32, thus providing the desired rapid traversing action necessary for the proper yarn helix angle on an empty or near-empty bobbin. As yarn accumulates on the bobbin, the package diameter increases and the bobbin r.p.m. decreases, gradually changing the helix angle of the yarn on the bobbin. At some time before the helix angle reaches an undesirable value, switch command 52 produces an output signal on conductor 54 to one input of AND gate 42. Switch command 52 may comprise a timer, producing its output signal at some predetermined time interval after winding begins, or may produce its output signal in response to bobbin diameter, r.p.m., or other factors. The next sync signal 40 to the remaining input terminal of AND gate 42 produces an output signal on conductor 56, actuating switch 24. Switch 24 accordingly switches motor 20 from output 30 to output 26 during a time interval when the output frequencies are substantially identical, to provide for smooth or "bumpless" transfer of motor 20 to be driven by output 26. In the particular program depicted in FIG. 3, the lower frequency $L_S$ of output 30 is slightly higher than the highest frequency $U_R$ of output 26, and occurs a small interval prior to occurrence of $U_R$, to compensate for the time interval required for switch 24 to complete the transfer to output 26. During this time interval, motor 20 is not energized and accordingly decelerates to the speed corresponding to $U_R$, effecting the bumpless transfer. Such minor deviations from literal identical values for $L_S$ and $U_R$ are included within the meaning of "substantially identical" as used herein.

The program illustrated in FIG. 1 is merely exemplary, and other functions of frequency versus time may be used. Indeed, under some conditions, output 30 may be of constant frequency, for example having the constant value $L_S$.

Figure 2:
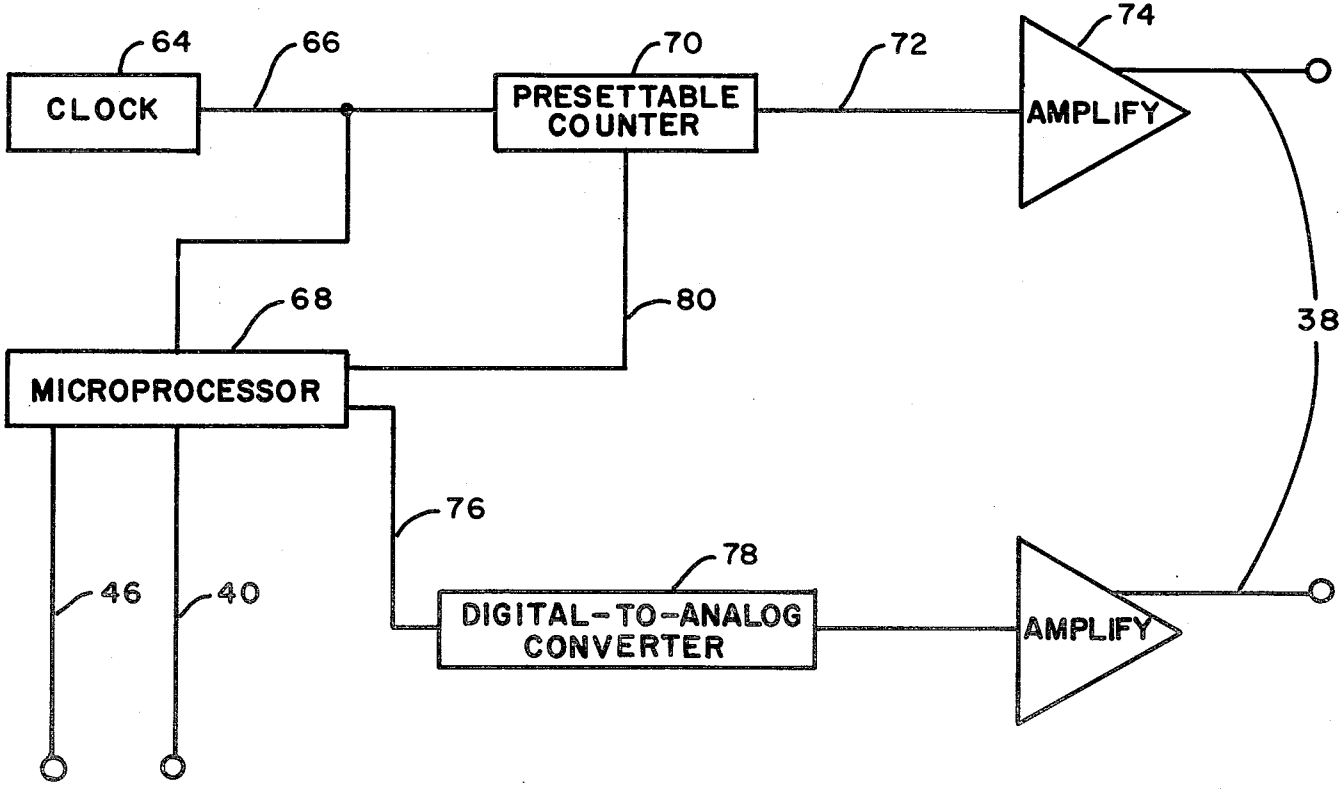
FIG. 2 is a block diagram of the master modulated oscillator in FIG. 1.

While driving inverters 28 and 32 to produce the desired output frequencies may be readily accomplished by those skilled in the art, for example by analog control, the preferred means for accomplishing this function is illustrated in FIG. 2, which shows master modulated oscillator 36.

Clock 64 is a 12 Mhz crystal oscillator producing clock pulses on conductor 66 to microprocessor 68 and to presettable counter 70. Under the control of microprocessor 68, which may be a Motorola MC 6802P, presettable counter 70 divides the frequency of oscillator 64 to provide an output square wave signal on conductor 72 having six times the desired output frequency of inverter 28 when the inverter is the commercially available unit manufactured by Emerson. The output square wave is suitably amplified and shaped in amplifier 74 for presentation to the inverter input terminal 38. In some inverters, a separate voltage control input signal is required, such as the inverters commercially manufactured by General Electric. In such a case, a digital output signal from microprocessor 68 on conductor 76 is converted to an analog signal by conventional converter 78, amplified, and fed to the appropriate inverter voltage control input terminal.

The preferred presettable counter is a chain of five integrated circuits SN 74192P made by Texas Instruments, connected at 80 to be preset periodically according to the program stored in microprocessor 68. Microprocessor sync output pulses are produced on conductors 46 and 40. If desired, these may be combined, so that the same pulse that supplies the AND gates also synchronize the slave modulated oscillator 48.

Figure 3:
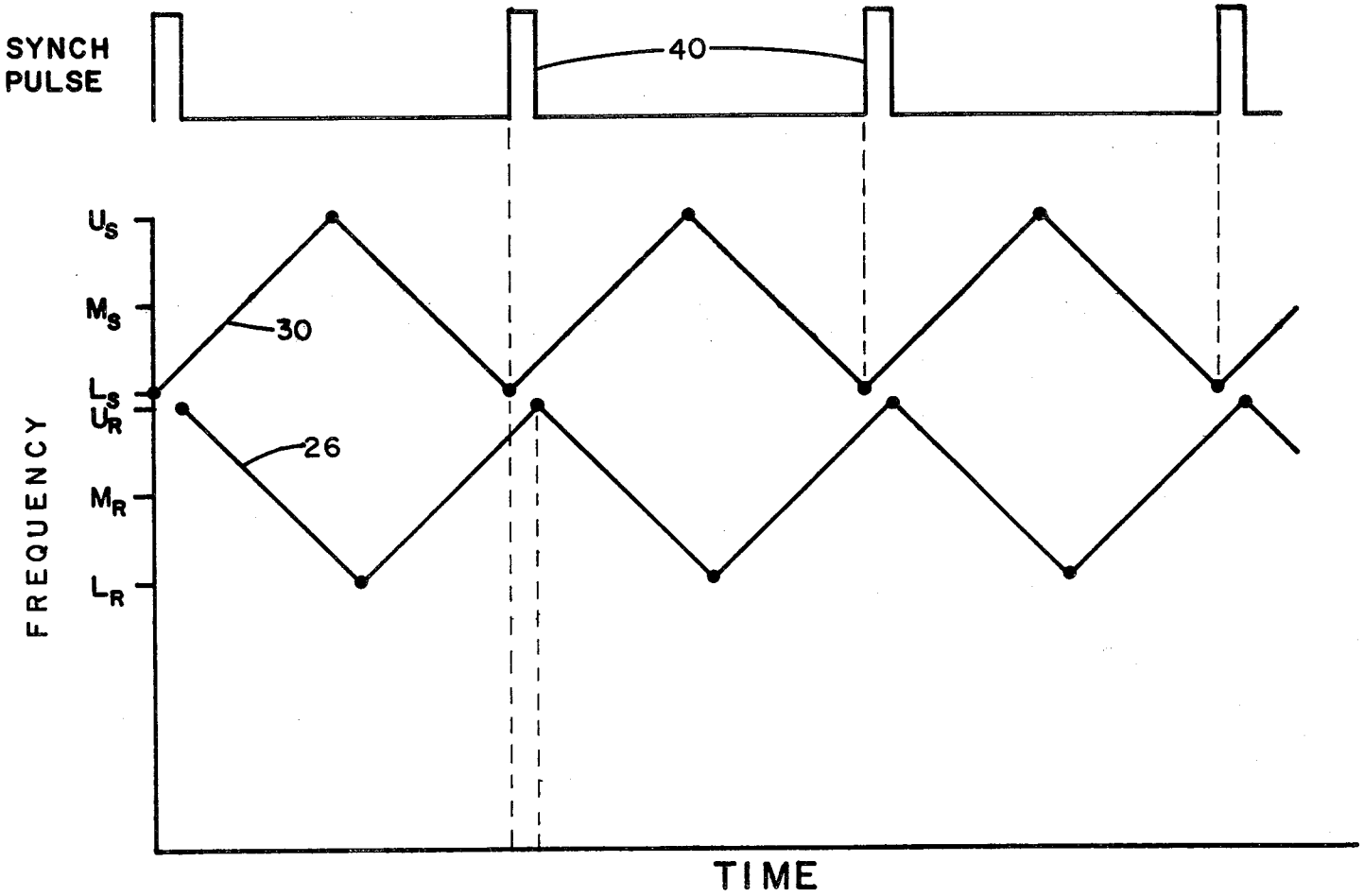
FIG. 3 is a graph showing an exemplary program of output frequencies of the FIG. 1 inverters.

Slave modulated oscillator 48 may be substantially identical except that its microprocessor is programmed to be synchronized by the signal received on conductor 46, and of course its programming may differ from that of microprocessor 68 so as to produce the desired frequency modulation 30 (FIG. 3).

What is claimed is:

1. A process for controlling a plurality of yarn traversing mechanisms, each of said traversing mechanism controlling the winding of a corresponding yarn package, comprising:

(a) independently connecting each of said traversing mechanisms to a first source of first alternating current having a first mean frequency during winding of a first portion of the corresponding yarn package controlled by each said traversing mechanism; and (b) independently switching each of said traversing mechanisms to a second source of second alternating current having a mean frequency lower than said first mean frequency during winding of a further portion of the corresponding yarn package controlled by each said traversing mechanism.

2. The process defined in claim 1, wherein the frequency of said second alternating current substantially continually varies between an upper and a lower value for said second alternating current.

3. The process defined in claim 2, wherein said first and said second alternating currents periodically have substantially identical frequencies to provide time intervals for bumpless transfer of said traversing mechanisms from being driven by said first alternating current source to being driven by said second alternating current source.

4. The process defined in claim 3, wherein the frequency of said first alternating current substantially continually varies between an upper and a lower value for said first alternating current.

5. A ribbon-breaking apparatus for a multiple-position winding machine comprising, in combination:

(a) a first inverter providing an output frequency having a first mean value;

(b) a plurality of A.C. motors, each of said motors being coupled to drive a yarn traverse mechanism;

(c) means for independently connecting each of said motors to the output of said first inverter;

(d) a second inverter;

(e) modulator means for modulating the output frequency of said second inverter about a second mean value lower than said first mean value and between upper and lower frequencies;

(f) said modulator means being constructed and arranged such that said output frequencies are periodically substantially identical to provide time intervals for bumpless transfer of said motors; and (g) means for independently switching each of said motors from the output of said first inverter to the output of said second inverter during said time intervals.

6. The apparatus defined in claim 5, further comprising further modulator means for modulating the output frequency of said first inverter about said first mean value between upper and lower frequencies.

* * * * *